US009509053B2

(12) United States Patent
Hsieh et al.

(10) Patent No.: US 9,509,053 B2
(45) Date of Patent: Nov. 29, 2016

(54) ELECTRONIC DEVICE

(71) Applicant: ASUSTeK COMPUTER INC., Taipei (TW)

(72) Inventors: Wang-Ta Hsieh, Taipei (TW); Chuan-Chien Huang, Taipei (TW); Kuei-Shun Yeh, Taipei (TW); Wei-Hsin Shih, Taipei (TW); Chih-Chan Liang, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 204 days.

(21) Appl. No.: 14/294,163

(22) Filed: Jun. 3, 2014

(65) Prior Publication Data

US 2015/0009074 A1 Jan. 8, 2015

Related U.S. Application Data

(60) Provisional application No. 61/843,455, filed on Jul. 8, 2013.

(30) Foreign Application Priority Data

Nov. 8, 2013 (TW) ..... 102140779 A

(51) Int. Cl.

| | |
|---|---|
| ***H01Q 1/38*** | (2006.01) |
| ***H01Q 9/04*** | (2006.01) |
| *H01Q 1/24* | (2006.01) |
| *H01Q 5/371* | (2015.01) |

(52) U.S. Cl.

CPC ..... *H01Q 9/0421* (2013.01); *H01Q 1/243* (2013.01); *H01Q 1/38* (2013.01); *H01Q 5/371* (2015.01)

(58) Field of Classification Search

CPC ..... H01Q 1/24; H01Q 1/38

USPC ..... 343/700 MS, 702, 767

See application file for complete search history.

(56) References Cited

U.S. PATENT DOCUMENTS

| | | | | |
|---|---|---|---|---|
| 8,319,691 | B2 | 11/2012 | Tsai et al. | |
| 8,816,924 | B2 * | 8/2014 | Wong | H01Q 1/243 343/702 |
| 2011/0193761 | A1 * | 8/2011 | Shinkai | H01Q 1/38 343/817 |
| 2012/0206301 | A1 * | 8/2012 | Flores-Cuadras | H01Q 1/243 343/700 MS |
| 2012/0326943 | A1 * | 12/2012 | Flores-Cuadras | H01Q 1/243 343/893 |
| 2013/0229317 | A1 * | 9/2013 | Mumbru | H01Q 1/243 343/767 |

FOREIGN PATENT DOCUMENTS

| | | | |
|---|---|---|---|
| CN | 1381921 | A | 11/2002 |
| CN | 102082318 | A | 6/2011 |
| TW | M361730 | U | 7/2009 |
| TW | 201119140 | A1 | 6/2011 |
| TW | M453978 | U | 5/2013 |
| TW | 201328020 | A | 7/2013 |

* cited by examiner

*Primary Examiner* — Huedung Mancuso

(74) *Attorney, Agent, or Firm* — CKC & Partners Co., Ltd.

(57) ABSTRACT

An electronic device includes a conducting element, a supporting element, and a multiband antenna is disclosed. The conducting element is connected to the ground of the electronic device by a high impedance connection. The supporting element has a supporting surface, and the supporting surface and the conducting element are perpendicular. The multiband antenna is disposed at the supporting surface and includes a radiating element, and the radiating element and the conducting element form a coupling capacitor.

12 Claims, 17 Drawing Sheets

ELECTRONIC DEVICE

CROSS-REFERENCE TO RELATED APPLICATION

This application claims the priority benefits of U.S. provisional application Ser. No. 61/843,455, filed on Jul. 8, 2013 and Taiwan application serial No. 102140779, filed on Nov. 8, 2013. The entirety of the above-mentioned patent applications are hereby incorporated by references herein and made a part of specification.

BACKGROUND OF THE INVENTION

1. Field of the Invention

The invention relates to an electronic device and, more particularly, to an electronic device with an antenna.

2. Description of the Related Art

In wireless communication, a mobile device usually needs a competent transceiver system to maintain the two-way communication quality between the mobile device and the base station. A dipole antenna and a monopole antenna are usually disposed at the external surface of the mobile device or integrated to the mobile device. Another type of antenna used commonly is a planar inverted F antenna (PIFA), and the FIFA is usually configured in the mobile device. However, if the dimension of the antenna is large, it is not easy to integrate it to the mobile device.

Conventionally, a multiband antenna can be operated at multiple communicating bands by switching different matching circuits. However, an additional switch or a biasing circuit is needed, which makes the manufacture more complicated and the cost is increased.

As the mobile device becomes lighter, thinner and smaller, the space for disposing an antenna becomes narrower. Moreover, many components inside or outside the mobile device are made of metal, such as the metal housing, and the radiating loss of the antenna is large due to the electric field concentration, which makes the manufacture of a multiband antenna more difficult.

BRIEF SUMMARY OF THE INVENTION

An electronic device includes a conducting element, a supporting element and a multiband antenna. The conducting element is connected to a ground of the electronic device by high impedance connection. The supporting element includes a supporting surface which is vertical to the conducting element. The multiband antenna is disposed at the supporting surface and includes a radiating element. The radiating element and the conducting element form a coupling capacitor.

The electronic device reduces the effect from the metal components in the mobile device on the antenna, and enables the antenna to operate at more bands.

These and other features, aspects and advantages of the present invention will become better understood with regard to the following description, appended claims, and accompanying drawings.

DETAILED DESCRIPTION OF THE EMBODIMENTS

The invention is illustrated with relating figures, and any person with ordinary skills in the art can change or modify it after they know the embodiments of the invention, which is still within the scope of the invention. On the other hand, common elements and steps are omitted in the embodiments, so as to avoid restriction on the invention.

Figure 1:
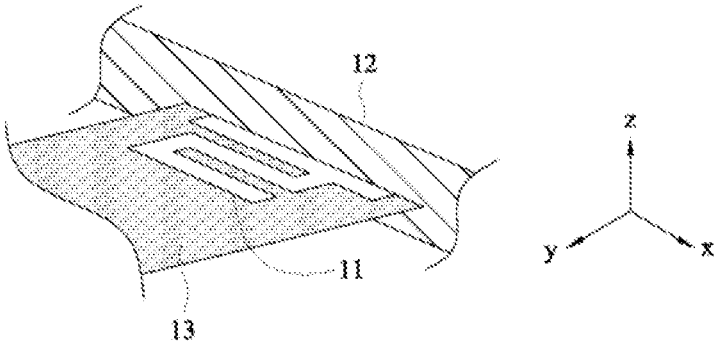
FIG. 1 is a schematic diagram showing an electronic device in the first embodiment.
Figure 2:
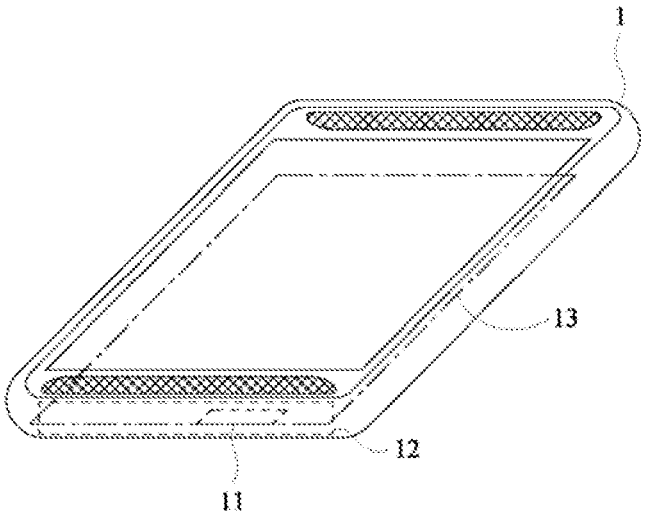
FIG. 2 is a schematic diagram showing an electronic, device in the first embodiment applied to a mobile device.
Figure 3:
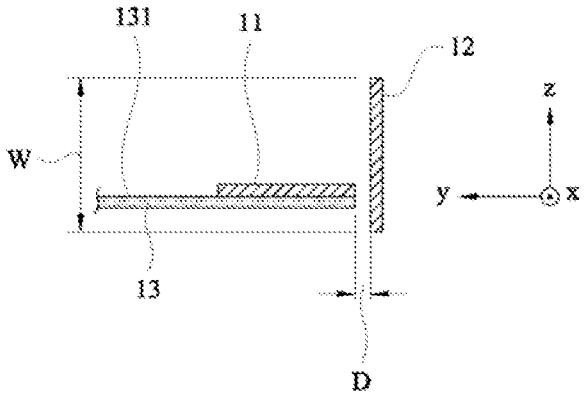
FIG. 3 is a sectional showing an electric device in the first embodiment.

FIG. 1 is a schematic diagram showing an electronic device in the first embodiment, FIG. 2 is a schematic diagram showing an electronic device in the first embodiment applied to a mobile device, and FIG. 3 is a sectional diagram showing an electronic device in the first embodiment. As shown in FIG. 1, the electronic device includes a multiband antenna 11, a conducting element 12 and a supporting element 13. The supporting element 13 includes a supporting surface 131 and the supporting surface 131 is vertical to the conducting element 12. A gap is formed between the multiband antenna 11 and the conducting element 12, and the conducting element 12 is connected to a ground of the electronic device by high impedance connection. In the embodiment the "high impedance connection" is an open circuit, which is not limited herein.

In the embodiment, as shown in FIG. 2 and FIG. 3, the electronic device can be applied to the mobile device 1, the conducting element 12 (such as a metal frame or a metal panel of the mobile device 1) has a width, and surrounds the periphery of the mobile device 1. The multiband antenna 11 is disposed at the supporting surface 131 of the supporting element 13. It is inside the mobile device 1 and vertical to the conducting element 12, and a gap exists therebetween. The multiband antenna 11 can be disposed in any side of the mobile device 1, which is not limited to the embodiment in FIG. 2. A distance D (such as 0.1 to 1 mm) is formed between the multiband antenna 11 and the conducting element 12. The multiband antenna 11 is vertical to the conducting element 12 and is disposed within a range of the width W of the conducting element 12.

Figure 4:
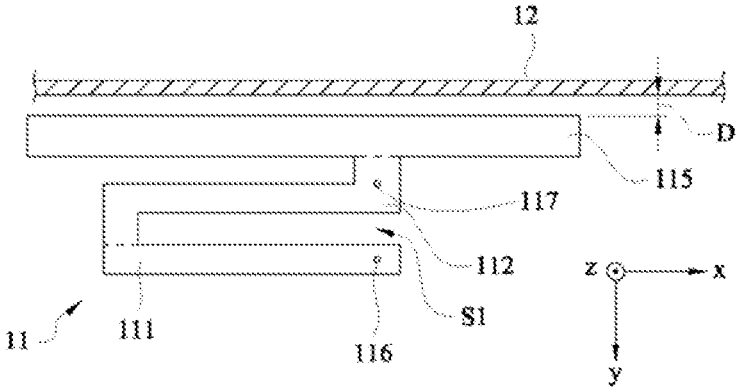
FIG. 4 is a side view showing an electronic device in the first embodiment.

FIG. 4 is a side view showing an electronic device in the first embodiment. As shown in FIG. 4, the multiband antenna 11 includes a grounding section 111, a feeding section 112 and a radiating element 115. The feeding section 112 includes a feeding point 117 for feeding a signal, and the feeding section 112 is electrically connected to the radiating element 115. The grounding section 111 includes a grounding point 116 connected to the ground, and the grounding section 111 is electrically connected to the feeding section 112. In the following illustration and figures, since the multiband antenna always includes the grounding section, the feeding section and the radiating element, the feeding section includes the feeding point, and the grounding section includes the grounding point, they are omitted in the following, and the symbols can be deduced by analogy.

In the embodiment, when the supporting element 13 is a circuit board of the mobile device 1 (as shown in FIG. 2), the multiband antenna 11 is disposed at the circuit board directly, and the surface of the circuit board is the supporting surface 131. the grounding point 116 is electrically connected to a ground at the circuit board by wiring or holing. In another embodiment, when the supporting element 13 is not the circuit board in the mobile device 1, the multiband antenna 11 is disposed on the supporting element 13, and the grounding point 116 is electrically connected to the ground of the circuit board via a metal elastic element or a thimble, which is not limited herein.

A first slot S1 is formed between the grounding section 111 and the feeding section 112. The longer the grounding section 111 and the feeding section 112 are, the longer the first slot S1 is, and the length of the first slot S1 can be adjusted to make the impedance of the multiband antenna 11 conform to a constant value (such as 50 Ω).

The radiating element 115 is parallel to the feeding section 112, the radiating element 115 resonates at a first band to transmit or receive an electromagnetic signal. A distance (such as 0.1 to 1 mm is formed between the radiating element 115 and the conducting element 12. The radiating element 115 is capacitive coupled to at least part of the conducting element 12, and it resonates at a second band to transmit or receive an electromagnetic signal. Thus, the electronic device can meet various communication requirements at multiband via the multiband antenna 11. In the embodiment, the frequency of the first band is higher than that of the second band.

The length of the radiating element 115 can be adjusted. When the radiating element 115 is longer, the radiating element 115 resonates at a lower frequency to transmit or receive the electromagnetic signal, and thus the first band would shift to lower frequencies. On the contrary, when the radiating element 15 is shorter, the radiating element 115 resonates at a higher frequency to transmit or receive the electromagnetic signal, and thus the first band would shift to higher frequencies. Consequently, the length of the radiating element 115 can be adjusted according to the required operating band.

Since the length of the radiating element 115 can affect the resonant frequency of the first hand and the second band, and when the space is limited, the radiating element 115 is bent to increase its length for lower the resonant frequency of the first hand and the second band.

The feeding point 17 of the multiband antenna 11 is electrically connected to a transceiver of the mobile device 1 (as shown in FIG. 2). For example, the transceiver of the mobile device has a wideband code division multiple access (WCDMA) communication function.

As shown n FIG. 4, the feeding point 117 is disposed at the feeding section 112, which is not limited herein. In other embodiments, the feeding point 117 may be disposed at any position of the radiating element 115. Since the U-shaped channel formed by the grounding section 111 and the feeding section 112 can guide the current in the multiband antenna. 11 back to the grounding point 116. In the previous embodiment, the feeding point 117 can he disposed at multiple positions of the multiband antenna 11, however, the relative position between the feeding point 117 and the grounding point 116 should be limited. One end of the grounding section 111 which is not connected to the feeding section 112 is called a bottom end of the grounding section 111, and the feeding point 117 can be disposed at any position of the multiband antenna 11 except the pan between the grounding point 116 to the bottom end of the grounding section 111.

Figure 5:
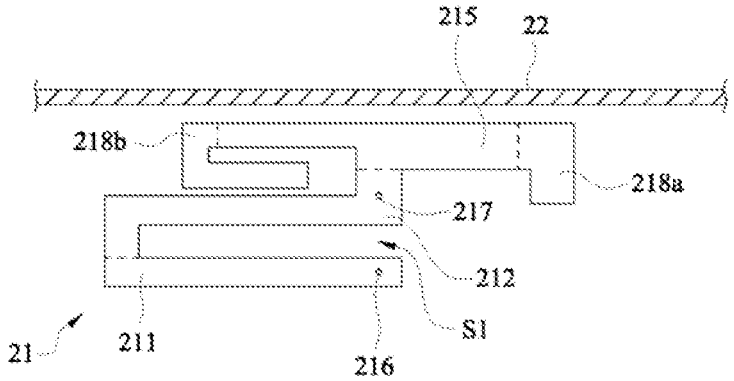
FIG. 5 is a side view showing an electronic device in the second embodiment.

FIG. 5 is a side view showing an electronic device in the second embodiment. As shown in FIG. 5, the electronic device includes the multiband antenna 21 and the conducting element 22. The difference between the first embodiment and the second embodiment is that the radiating element further includes a first radiating section 215 and second radiating sections 218*a* and 218*b*. The second radiating sections 218*a* and 218*b* are connected to different ends of the first radiating section 215, respectively. In the embodiment, the second radiating section 218*a* is an L-shaped element, and a gap is formed between the second radiating section 218*a* and the conducting element 22.

The second radiating section 218*b* includes a bending portion which is between the conducting element 22 and the feeding section 212. In the embodiment, the second radiating section 218*b* is a U-shaped element. One end of the U-shaped element is connected to the radiating section 215 and a gap is formed between the U-shaped element and the conducting element 22. The other end of the U-shaped element is disposed between the radiating section 215 and the feeding section 212 and parallels to the feeding section 212. The second radiating sections 218*a*, 218*b* and the radiating section 215 are coplanar, and all of or a part of them can be disposed, which is not limited herein.

Figure 6:
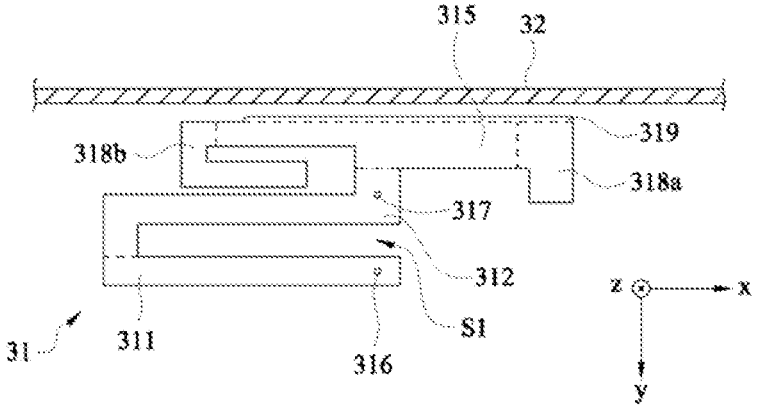
FIG. 6 is a side view showing an electronic device in the third embodiment.
Figure 7:
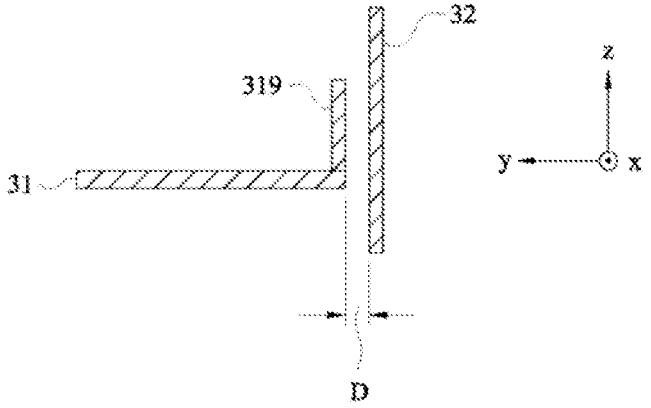
FIG. 7 is a sectional diagram showing an electronic device in the third embodiment.

FIG. 6 is a side view showing an electronic device in the third embodiment, and FIG. 7 is a sectional diagram showing an electronic device in the third. embodiment. As shown in FIG. 7, the electronic device includes the multiband antenna 31 and the conducting element 32. The difference between the third embodiment and the second embodiment is that the radiating element further includes a third radiating section 319 which is connected to the first radiating section 315 and the second radiating section 318*a*, or is only connected to the first radiating section 315 according to requirements. As shown in FIG. 7, the relative position of the third radiating section 319 and the conducting element 32 is shown more clearly. The third radiating section 319 extends along a surface vertical to a surface where the first radiating section 315 is at. The surface where the third radiating section 319 is at the surface parallels to the conducting element 32, and a distance D (such as 0.1 to 1 mm) is formed therebetween. Since the third radiating section 319 reinforces the capacitive coupling effect between the first radiating section 315 and the conducting element 32, the first radiating section 315 and the conducting element 32 resonate at a lower band, and thus the second band is shifted to a lower band.

As shown in FIG. 6, since the first band and the second band can be shifted by adjusting the length of the first radiating section 315, the second radiating sections 318*a*, 318*b* and the third radiating section 319, when a resonating frequency of the radiating sections is adjusted to make the first band and the second band overlap, a wider band is formed, and the electronic device can operate at a broadband via the multiband antenna 31.

As shown in the electronic device of FIG. 4, FIG. 5 and FIG. 6, the conducting elements 12, 22 and 32 do not need to be connected to the multiband antennas 11, 21 and 31 directly. Thus, the mobile device 1 (shown in FIG. 2) does not need additional screws or conductive bridging structures to connect the conducting elements 12, 22 and 32 to the multiband antennas 11, 21 and 31 directly, which saves the manufacture cost of the mobile device, avoids assembly errors in fixing screws or attaching conductive tape, and avoids the radiating efficiency of the multiband antennas 11, 21 and 31 being affected.

Figure 8:
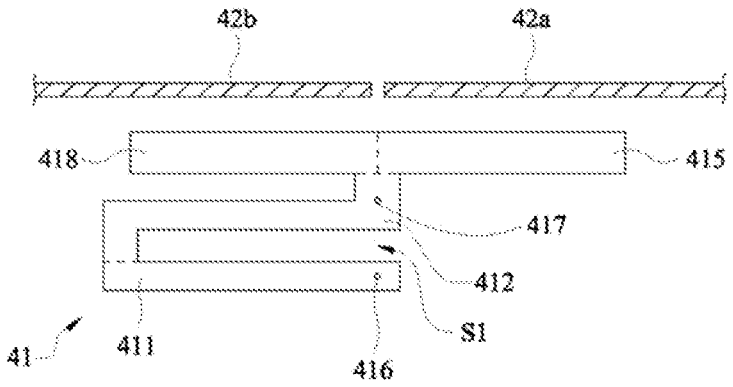
FIG. 8 is a side view showing an electronic device in the fourth embodiment.

FIG. 8 is a side view showing an electronic device in the fourth embodiment As shown in FIG. 8, the difference between the electronic device in the fourth embodiment and in the first embodiment is that the conducting element limber includes a first conducting section 42*a* and a second conducting section 42*b*. The second conducting section 42*b* and the first conducting section 42*a* are coplanar, and a gap is formed therebetween. Taking the feeding point 417 at the multiband antenna 41 as a dividing point, the radiating element can be divided to the first radiating section 415 and the second radiating section 418. The first radiating section 415 resonates at the first band to transmit or receive an electromagnetic signal. The first radiating section 415 is capacitive coupled to the first conducting section 42*a* to form a first coupling capacitor, and the multiband antenna 41 resonates at the second band to transmit or receive an electromagnetic signal. The second radiating section 418 resonates at the third hand to transmit or receive an electromagnetic signal. The second radiating section 418 is capacitive coupled to the second conducting section 42*b* to form a second coupling capacitor, and the multiband antenna 41 resonates at the fourth band to transmit or receive an electromagnetic signal. Consequently, when the electronic device is applied to the mobile device, it can meet the communication requirement of multiband via the multiband antenna 41.

Figure 9:
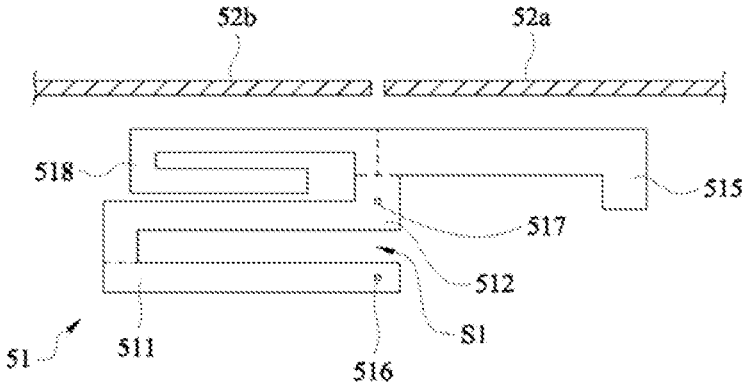
FIG. 9 is a side view showing an electronic device in the fifth embodiment.

FIG. 9 is a side view showing an electronic device in the fifth embodiment. As shown in FIG. 9, the electronic device includes the multiband antenna 51, the first conducting section 52*a* and the second conducting section 52*b*. The radiating element includes the first radiating section 515 and the second radiating section 518. The difference between the fifth embodiment and the fourth embodiment is that one of or both the first radiating section 515 and the second radiating section 518 include a bending portion to increase the length of the radiating element. Since the first radiating section 515 and the second radiating section 518 are illustrated in the previous embodiments, the relating illustrations are omitted herein. The radiating path of the antenna can be increased via the bending portions of the first radiating section 515 and the second radiating section 518, and the first band and the third band are shifted to lower frequencies.

Figure 10:
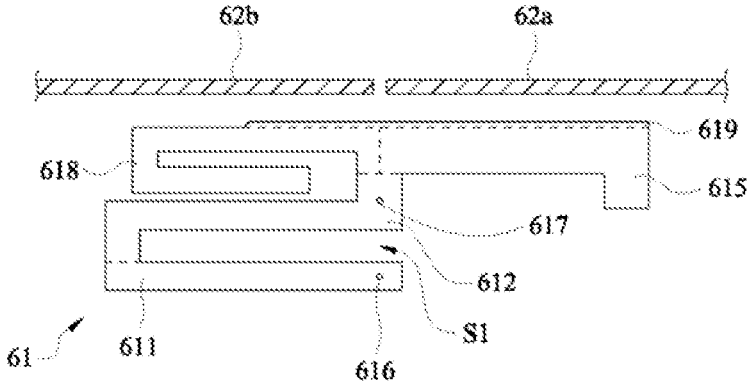
FIG. 10 is a side view showing an electronic device in the sixth embodiment.

FIG. 10 is a side view showing an electronic device in the sixth embodiment. As shown in FIG. 10, the electronic device includes the multiband antenna 61, the first conducting section 62*a* and the second conducting section 62*b*, and the radiating element includes the first radiating section 615 and the second radiating section 618. The difference between the sixth embodiment and the fifth embodiment is that the radiating element further includes a third radiating section 619 connected to the first radiating section 615 and the second radiating section 618, or only connected to the first radiating section 615 according to requirements. The relative position of the third radiating section 619 and the conducting element 62 can refer to the embodiment in FIG. 7. Since the third radiating section 619 is illustrated in the previous embodiment, the relating illustration is omitted herein.

Since the third radiating section 619 reinforces the capacitive coupling effect of the first radiating section 615 and the first conducting section 62*a*, the first radiating section 615 and the first conducting section 62*a* resonate at a lower band, and thus the second band is shifted to a lower baud. Furthermore, since the third radiating section 619 reinforces the capacitive coupling effect between the first radiating section 615 and the second conducting section 62*b*, a coupling capacitor is formed between the third radiating section 619 and the second conducting section 62*b*. The first radiating section 615 and the second conducting section 62*b* resonate at a lower band, and thus the fourth band is shifted to a lower band.

Figure 11:
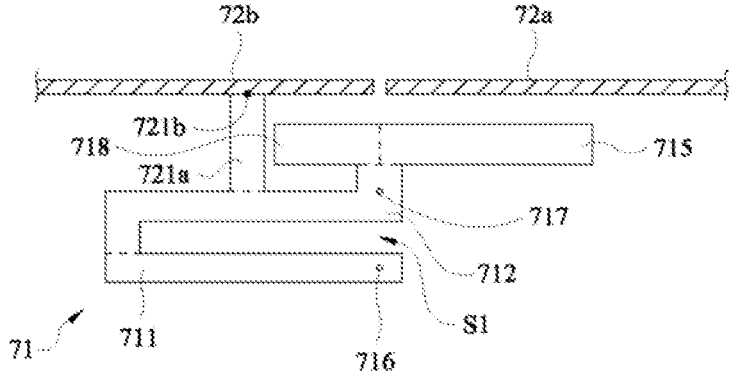
FIG. 11 is a side view showing an electronic device in the seventh embodiment.
Figure 12:
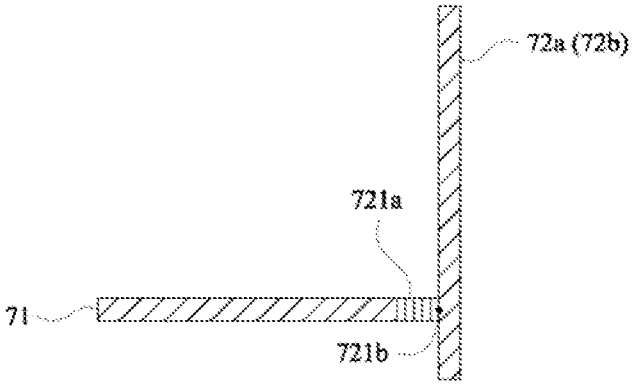
FIG. 12 is a sectional diagram showing an electronic device in the seventh embodiment.

FIG. 11 is a side view showing, an electronic device in the seventh embodiment. As shown in FIG. 11, the electronic device includes the multiband antenna 71, the first conducting section 72*a* and the second conducting section 72*b*. The difference between the seventh embodiment and the fourth embodiment is that the radiating element further includes a fourth radiating section 721*a*. One end of the fourth radiating section 721*a* is connected to the feeding section 712, and the other end is physically connected to the second conducting section 72*b* via a connecting point 721*b*. The fourth radiating section 721*a* and the feeding section 712 are coplanar, and a gap is formed between the fourth radiating section 721*a* and the second radiating section 718. As shown in FIG. 12, the relative positions of the fourth radiating section 721*a*, the connecting point 721*b*, the first conducting section 72*a* and the second conducting section 72*b* in the multiband antenna 71 are shown more clearly.

Figure 13:
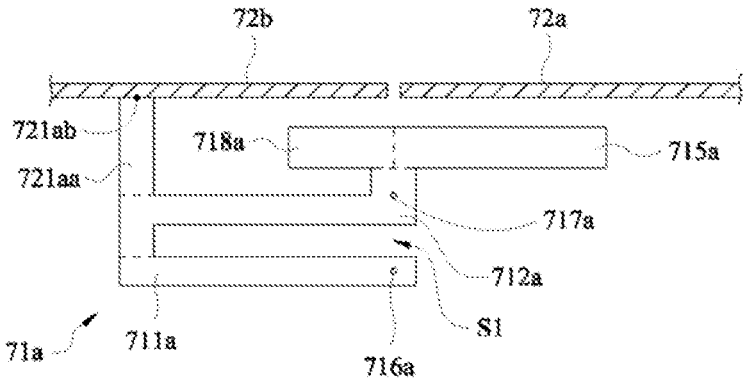
FIG. 13 is a side view showing an electronic device in the eighth embodiment.

As shown in FIG. 13, in the embodiment, the electronic, device includes the multiband antenna 71*a*, the first conducting section 72*a* and the second conducting section 72*b*, and the radiating element includes the first radiating section 715*a*, the second radiating section 718*a* and the fourth radiating section 721*aa*. One end of the fourth radiating section 721*aa* is vertically connected to one end of the feeding section 712*a* which is connected to the grounding section 711*a*. As shown in FIG. 11 and FIG. 13, the fourth radiating section 721*aa*, the feeding section 712*a* and the grounding section 711*a* form a planar inverted F antenna (PIFA) and the PIFA can operate at the first band, the second band, the third band and the fourth band illustrated in the previous embodiments.

Figure 14:
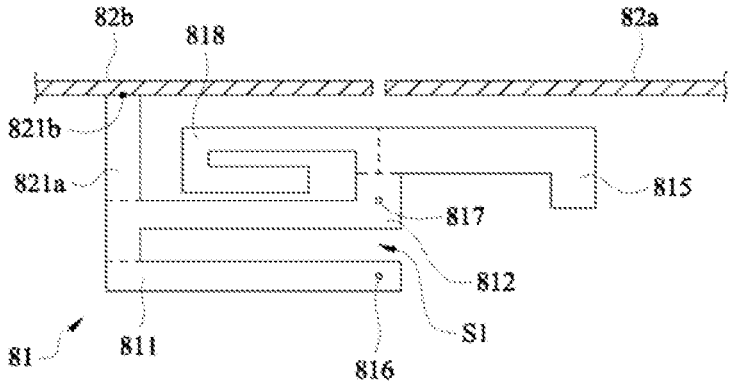
FIG. 14 is a side view showing an electronic device in the ninth embodiment.

As shown in FIG. 14, similar with the embodiment in FIG. 13, the electronic device includes the multiband antenna 81, the first conducting section 82*a* and the second conducting section 82*b*. However, one of or both the first radiating section 815 and the second radiating section 818 of the radiating element include a bending portion to increase the length of the radiating element. The first radiating section 815 and the second radiating section 818 are illustrated in the previous embodiments. which is omitted herein. The bending portions of the first radiating section 815 and the second radiating section 818 can increase the radiating path of the antenna and make the first band and the third band shift to lower frequencies.

Figure 15:
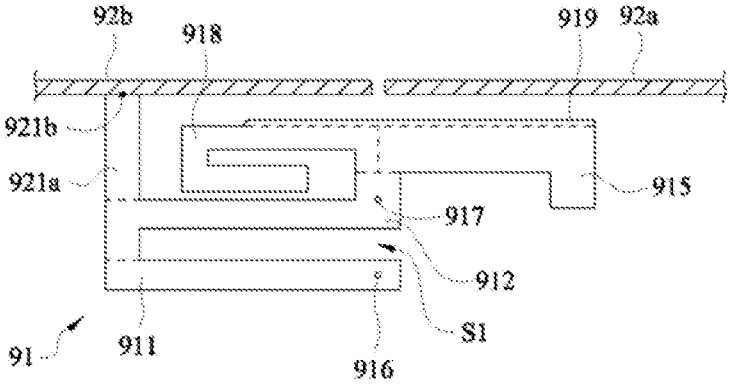
FIG. 15 is a side view showing an electronic device in the tenth embodiment.
Figure 16:
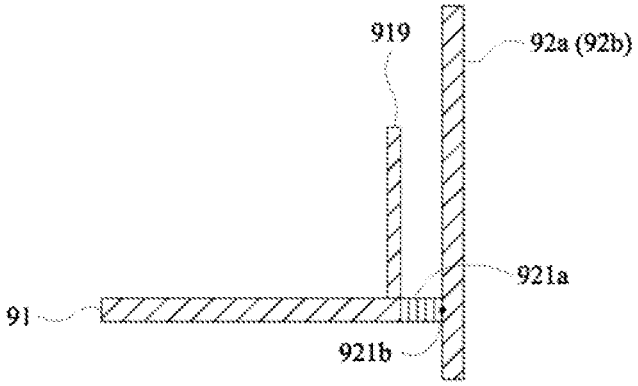
FIG. 16 is a sectional diagram showing an electronic device in the tenth embodiment.

As shown in FIG. 15, similar with the embodiment in FIG. 14, the electronic device includes the multiband antenna 91, the first conducting section 92*a* and the second conducting section 92*b*. However, the radiating element includes the first radiating section 915, the second radiating section 918 and the fourth radiating section 921*a*, and also includes the third radiating section 919. The third radiating section 919 is connected to the first radiating section 915 and the second radiating section 918. Since the third radiating section 919 reinforces the capacitive coupling effect between the first radiating section 915 and the first conducting section 92*a*, the second band and the fourth band are shifted to a band at lower frequencies. In FIG. 16, the relative positions of the third radiating section 919, the fourth radiating section 921*a*, the connecting point 921*b*, the first conducting section 92*a* and the second conducting section 92*b* are shown more clearly.

Figure 17:
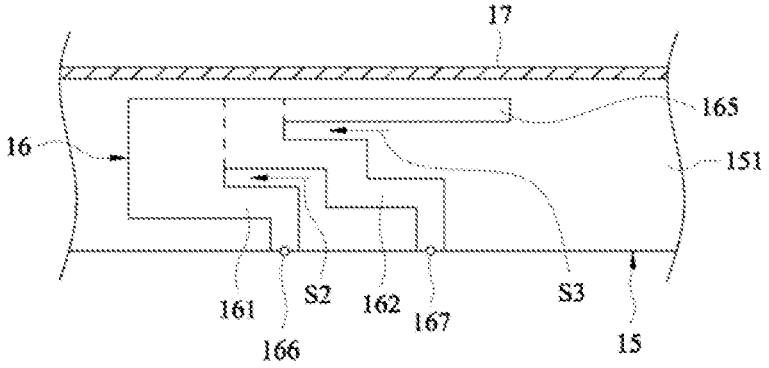
FIG. 17 is a side view showing an electronic device in an eleventh embodiment.

FIG. 17 is a side view showing an electronic device in the eleventh embodiment. As shown in FIG. 17, the multiband antenna 16 is disposed at the supporting surface 151 of the supporting element 15. The multiband antenna 16 includes the grounding section 161, the feeding section 162 and the radiating element 165. The grounding section 161 includes a grounding point 166 for connecting the ground. The feeding section 162 is a stepped type element, and includes a feeding point 167 for signals to feed in. A gap is formed between the feeding section 162 and the grounding section 161 and a first slot S2 is formed between the grounding section 161 and the feeding section 162. The length of the first slot S2 can be designed to adjust the impedance of the multiband antenna 16 to conform to a constant value (such as 50 Ω).

The radiating element 165 is connected to the feeding section 162 and a gap is existed between the radiating element 165 and the conducting element 17. A second slot S3 is formed between the radiating element 165 and the feeding section 162, and the length of the second slot S3 can be designed to adjust a first band. The radiating element 165 resonates at the first band to transmit or receive an electromagnetic signal. When the electronic device is applied to a mobile device (such as a mobile phone), the feeding point 167 is connected to a transceiver of the mobile device, and the radiating element 165 is in response to the electromagnetic radiation of the first band (such as 704 MHz to 960 MHz) and resonates to transmit or receive the electromagnetic signal. For example, the radiating element 165 receives the electromagnetic waves of the first band and resonates, so as to transmit the electromagnetic waves of the first band to the transceiver of the mobile device, or the transceiver of the mobile device transmits the electromagnetic waves of the first band to the radiating element 165, and the radiating, element 165 resonates to transmit out the electromagnetic waves of the first band.

The radiating element 165 is parallel to the conducting element 17, so a coupling capacitor is formed between the radiating element 165 and the conducting element 17, Thus, a bottom end of the multiband antenna 16 (which is one end of the radiating element 165 not connected to the feeding section 162) has a capacitive load, and can resonate with the inductive impedance (such as 50 Ω) of the multiband antenna 16 to lower the first band of the radiating element 165. Consequently, when the first band of the radiating element 165 keeps unchanged, the radiating element 165 can effectively reduce the layout area of the supporting surface 151 and reduce the cost by the coupling capacitor, and thus the antenna can be applied to a thinner mobile device.

Since the coupling capacitor between the radiating element 165 and the conducting element 17 is a distributive coupling capacitor and has a feature of broadband. Consequently, the radiating element 165 can operate at a wider band via the coupling capacitor, and the electronic device can adapt to more communication protocols. Furthermore, when the electronic device operates at the first band, a near-field electrical field generated by the resonance of the radiating element 165 concentrates on the area between the radiating element 165 and the conducting element 17. When the electronic device is used, the chance of affecting the wireless communication quality by user approaching the electronic device is reduced.

Figure 18:
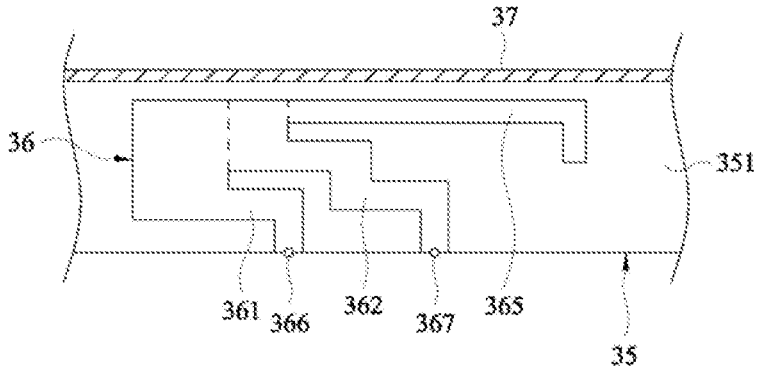
FIG. 18 is a side view showing an electronic device in the twelfth embodiment.

FIG. 18 is a side view showing an electronic device in the twelfth embodiment. As shown in FIG. 18, similar with the eleventh embodiment, the electronic device includes the supporting element 35, the multiband antenna 36 and the conducting element 37. The multiband antenna 36 includes the grounding section 361, the feeding section 362 and the radiating element 365. The grounding section 361 includes the grounding point 366 for connecting a ground, and the feeding section 362 includes the feeding point 367 for feeding signals. In FIG. 18, the radiating element 365 is an L-shaped element. One end of the radiating element 365 is connected to the feeding section 362 and a gap is formed between the radiating element 365 and the conducting element 37. The other end of the radiating element 365 which is not connected to the feeding section 362 bends towards a direction away from the conducting element 37. Thus, the end of the radiating element 365 away from the conducting element 37 can avoid the near-field electrical field concentrating on the area between the multiband antenna 36 and the conducting element 37, and further avoid the resonant energy loss in the near-field electrical field, and thus the radiating efficiency and the bandwidth of the electronic device can be improved.

Figure 19:
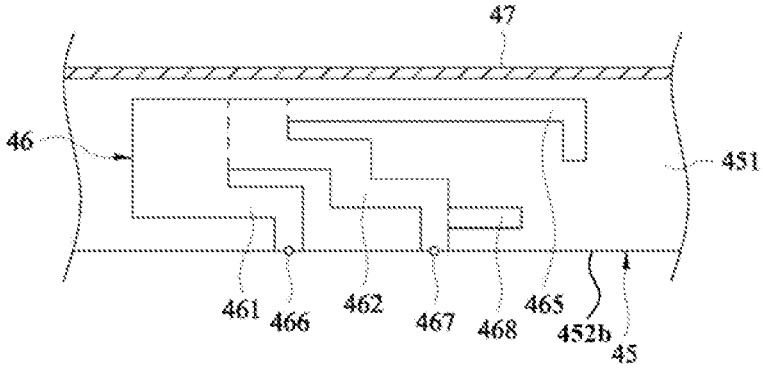
FIG. 19 is a side view showing an electronic device in the thirteenth embodiment.

FIG. 19 is a side view showing an electronic device in the thirteenth. embodiment. As shown in FIG. 19, similar with the twelfth embodiment, the electronic device includes the supporting element 45, the multiband antenna 46 and the conducting element 47. The multiband antenna 46 includes the grounding section 461, the feeding section 462 and the radiating element. The grounding section 461 includes the grounding point 466 for connecting a ground, and the feeding section 462 includes the feeding point 467 for signals to feed in. In FIG. 19 the radiating unit further includes a fifth radiating section 465 and a sixth radiating section 468. One end of the fifth radiating section 465 is connected to the feeding section 462 and a gap is formed between the fifth radiating section 465 and the conducting element 47. The other end which is not connected to the feeding section 462 bends towards a direction away from the conducting element 47. Thus, the end of the fifth radiating section 465 away from the conducting element 47 can avoid the near-field electrical field greatly concentering on the area between the multiband antenna 46 and the conducting element 47, and further avoid a resonant energy loss in the near-field electrical field, which can improve the radiating efficiency and the bandwidth of the electronic device. The sixth radiating section 468 is connected to the feeding section 462, and gaps are formed between the sixth radiating section 468 and the fifth radiating section 465, the sixth radiating section 468 and an edge 452*b* of the supporting surface, respectively. Compared with the fifth radiating section 465, an effective resonant current path of the sixth radiating section 468 is relatively short. Thus, the sixth radiating section 468 resonates at a higher second band (such as 1710 MHz to 2170 MHz), which allows the electronic device to operate at multiband.

Figure 20:
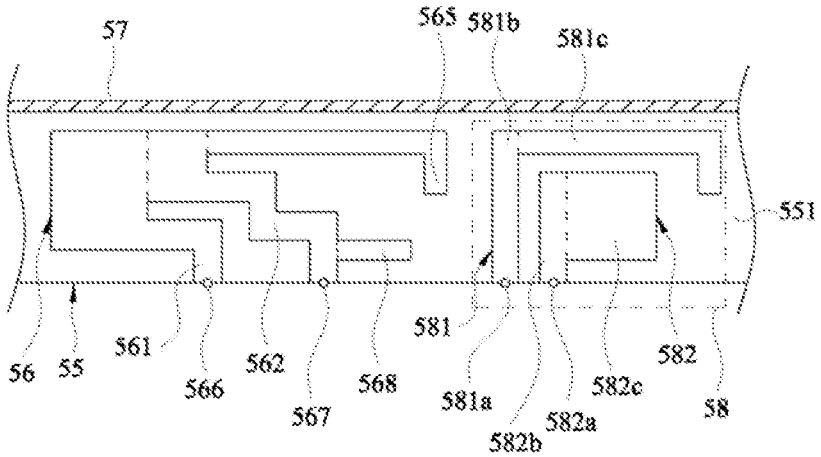
FIG. 20 is a side view showing an electronic device in the fourteenth embodiment.

FIG. 20 is a side view showing, an electronic device in the fourteenth embodiment. The electronic device includes the multiband antenna 56 similar with that in FIG. 19. As shown in FIG. 20, the electronic device further includes an additional multiband antenna 58, which makes the electronic device have another wireless communication application. The additional multiband antenna 58 includes an additional grounding section 581 and an additional feeding section 582.

The additional grounding, section 581 can be divided, to a first part 581*b* and a second part 581*c*, and the first part 581*b* is connected to the second part 581*c*. The first part 581*b* is a long strip shaped element and includes an additional grounding point 581*a* for connecting to ground. The second part 581*c* is an L-shaped element. One end of the second pan 581*c* is connected to the first part 581*b* which does not include the additional grounding point 581*a*. The other end is similar with the radiating element 565, and its can avoid the near-field electrical field concentration, and the resonant energy loss in the near-field electrical field, which can improve the radiating efficiency and the bandwidth of the electronic device.

The additional feeding section 582 can be divided to a first part 582*b* and a second part 582*c*, and the first part 582*b* is connected to the second part 582*c*. The first part 582*b* is a long strip shaped element and includes an additional feeding point 582*a* for feeding signals. The second part 582*c* is a square element. One side of the second part 582*c* is connected to the first part 582*b*, and a gap is formed between the second part 582*c* and the second pan 581*c* of the additional grounding section 581.

For example, the feeding point 567 is connected to a transceiver of the mobile device which has various communication applications, such as wideband code division multiple access (WCDMA). The additional feeding point 582*a* is electrically connected to another transceiver of the mobile device which has a wireless communication function, such as wireless local area network (WLAN).

The additional grounding point 581*a* is electrically connected to the ground at the circuit board of the mobile device. The second part 581*c* of the additional grounding section is coupled to the second part 582*c* of the additional feeding section, so as to make their resonant frequencies closer (such as 2.4 GHz to 2.5 GHz and 5 GHz) and form a wider operating band. The first part 581*b* of the additional grounding section is connected to the additional grounding point 581*a*, the second part 581*c* of the additional grounding section is connected to the ground, and thus an electromagnetic insolation between the additional multiband antenna 58 and the multiband antenna 56 is increased.

In another embodiment, the additional grounding section 581 may be electrically connected to the transceiver of the mobile device, and the additional feeding section 582 may be electrically connected to the ground at the circuit board of the mobile device, so as to allow the mobile device to meet other requirements. In the embodiment, the grounding point 566 and the additional grounding point 581*a* can be electrically connected to the ground at the circuit board of the mobile device via a metal elastic element or a thimble.

Figure 21:
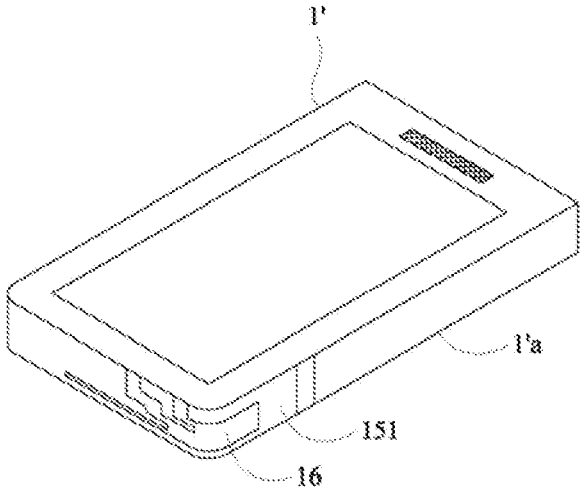
FIG. 21 is a front view showing a mobile device 1' when the electronic device is applied to the mobile device 1' in an embodiment.
Figure 22:
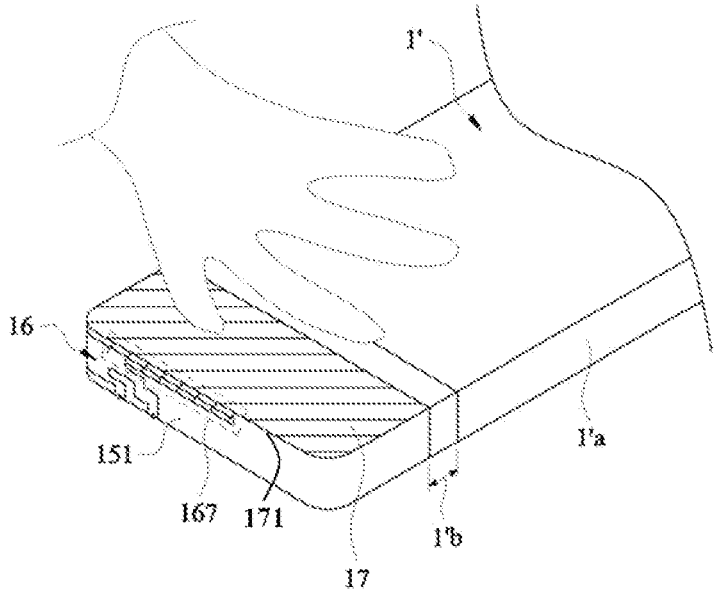
FIG. 22 is a back view showing a mobile device 1' when the electronic device is applied to the mobile device 1' in an embodiment.

FIG. 21 is a front view showing a mobile device 1' when the electronic device is applied to the mobile device 1' in an embodiment, and FIG. 22 is a back view Showing a mobile device 1' when the electronic device is applied to the mobile device 1' in an embodiment. The multiband antenna 16 is disposed at the supporting surface 151 of the supporting element. As shown in FIG. 21 and FIG. 22, the electronic device is disposed at the bottom end of a short side of the mobile device 1'. The electronic device can be disposed at the top end or the bottom end of the short side of the mobile device 1' according to requirements. The near-field electrical field 167 concentrates on the bottom end of the short side of the mobile device 1' when operating, even though the hand of the user touches the conducting element 17 of the electronic device when the long side of the mobile device 1' is hold as shown in FIG. 22, the operating frequency of the electronic device is not affected, and the radiating efficiency is not reduced. Thus, the wireless communication quality of the mobile device 1' can be maintained.

As shown in FIG. 22, the area where the near-field electrical field 167 concentrates on is far away from the user hand when operating, the electromagnetic waves radiating to the user are greatly reduced. Thus, the electronic device can reduce the threat of the electromagnetic waves of the mobile device on the user.

When the housing 1'*a* of the mobile device 1' is made of conductive materials, a distance 1'*b* is existed between the electronic device and the housing 1'*a* of the mobile device 1'. Since the housing 1'*a* is close to the conducting element 17 and far away from the area between the multiband antenna 16 and an edge 171, the housing 1'*a* does not affect the near-field electrical field 167 when operating the electronic. The electronic device can still be operated normally when the conductive housing is approached.

Although the present invention has been described in considerable detail with reference to certain preferred embodiments thereof, the disclosure is not for limiting the scope. Persons having ordinary skill in the art may make various modifications and changes without departing, from the scope. Therefore, the scope of the appended claims should not be limited to the description of the preferred embodiments described above.

What is claimed is:

1. An electronic device, comprising:

a conducting element connected to a ground of the electronic device by a high impedance connection;

a supporting element including a supporting surface which is vertical to the conducting element; and a multiband antenna disposed at the supporting surface, wherein the multiband antenna includes a radiating element, and the radiating element and the conducting element forms a coupling capacitor;

wherein the multiband antenna includes:

a feeding section including a feeding point and electrically connected to the radiating element; and a grounding section including a grounding point and electrically connected to the feeding section, wherein a first slot is formed between the grounding section and the feeding section.

2. The electronic device according to claim 1, wherein the high impedance connection is an open circuit.

3. The electronic device according to claim 1 wherein the radiating element includes:

a first radiating section; and a second radiating section connected to at least one end of the first radiating section, wherein the second radiating section is coplanar with the first radiating section.

4. The electronic device according to claim 3, wherein the second radiating section includes a bending portion, the bending portion is between the conducting element and the feeding section.

5. The electronic device according to claim 3, wherein the radiating element further includes:

a third radiating section connected to the first radiating section, wherein the third radiating section is parallel to the conducting element, and the third radiating section and the conducting element form the coupling capacitor.

6. The electronic device according to claim 1, wherein the conducting element includes:

a first conducting section; and a second conducting section which is coplanar and separated from the first conducting section.

7. The electronic device according to claim 6, wherein the radiating element includes:

a first radiating section; and a second radiating section connected to the first radiating section;

wherein the first radiating section and the first conducting section form a first coupling capacitor, and the second radiating section and the second conducting section form a second coupling capacitor.

8. The electronic device according to claim 6, wherein the radiating element further includes:

a third radiating section connected to the first radiating section, wherein the third radiating section is parallel to the conducting element, and the coupling capacitor is formed between the third radiating section and the conducting element.

9. The electronic device according to claim 6, wherein the radiating element further includes:

a fourth radiating section, wherein the fourth radiating section is connected between the feeding section and the second conducting section.

10. The electronic device according to claim 1, wherein the supporting element is made of a non-conducting material.

11. The electronic device according to claim 1, wherein the electronic device further includes:

an additional multiband antenna including:

an additional grounding section disposed at the supporting surface and including an additional grounding point for connecting to the ground; and an additional feeding section disposed at the supporting surface and separate d from the additional grounding section, wherein the additional feeding section includes an additional feeding point for feeding a signal.

12. An electronic device, comprising:

a conducting element connected to a ground of the electronic device by a high impedance connection, wherein the conducting element includes:

a first conducting section; and a second conducting section which is coplanar and separated from the first conducting section;

a supporting element including a supporting surface which is vertical to the conducting element; and a multiband antenna disposed at the supporting, surface, wherein the multiband antenna includes a radiating element, and the radiating element and the conducting element forms a coupling capacitor, wherein the radiating element includes:

a third radiating section connected to the first radiating section, wherein the third radiating section is parallel to the conducting element, and the coupling capacitor is formed between the third radiating section and the conducting element.

* * * * *